United States Patent [19]

Pflüger et al.

[11] 4,016,929

[45] Apr. 12, 1977

[54] HEAT-EXCHANGER

[75] Inventors: Ulrich Pflüger; Klemens Waterkotte, both of Herne, Germany

[73] Assignee: Pfluger Apparatebau GmbH & Co. KG, Herne, Germany

[22] Filed: June 5, 1975

[21] Appl. No.: 583,835

[30] Foreign Application Priority Data

June 8, 1974 Germany ..... 2427808

[52] U.S. Cl. ..... 165/159

[51] Int. Cl.[2] ..... F28D 7/00; F28F 9/22

[58] Field of Search ..... 165/159

[56] References Cited

UNITED STATES PATENTS

| | | | |
|---|---|---|---|
| 1,457,941 | 6/1923 | Shevlin | 165/159 |
| 1,982,010 | 11/1934 | McNeal | 165/159 |
| 2,340,853 | 2/1944 | Young | 165/159 |
| 2,391,244 | 12/1945 | Jackson | 165/159 |
| 2,513,124 | 6/1950 | Weiks | 165/159 |
| 2,589,730 | 3/1952 | Rathkey | 165/159 |
| 2,991,048 | 7/1961 | Rabin | 165/159 |
| 3,297,081 | 1/1967 | Nunemaker | 165/159 |
| 3,351,131 | 11/1967 | Berthold | 165/159 |

*Primary Examiner*—C. J. Husar
*Assistant Examiner*—Sheldon Richter
*Attorney, Agent, or Firm*—Michael J. Striker

[57] ABSTRACT

A heat-exchange arrangement includes a housing which has an inner surface defining a first flow path for a fluid to undergo heat-exchange. The inner surface of the housing comprises a pair of substantially parallel surface portions which bound the first flow path along the flow direction so that the first flow path is of substantially constant width along the flow direction. A plurality of spaced conduits is arranged in the first flow path and defines a series of second flow paths for a medium to undergo heat-exchange with a fluid flowing in the first flow path. The conduits are arranged such that substantially the same predetermined minimum distance separates the most closely spaced ones of the conduits. A plurality of baffles in the first flow path serves to regulate the flow pattern of a fluid flowing in the first flow path. The baffles are arranged in such a manner that, in the region between two adjacent ones of the baffles, the projected free flow cross-section of the first flow path as determined in a plane substantially paralleling the conduits is substantially equal to the projected free flow cross-section of the first flow path as determined in a plane substantially normal to the conduits. The arrangement outlined permits a more uniform heat-exchange than was possible heretofore to be achieved. In particular, the arrangement makes it possible to insure that the heat-exchange effect for any one of the conduits is approximately the same as for any other conduit.

12 Claims, 6 Drawing Figures

HEAT-EXCHANGER

BACKGROUND OF THE INVENTION:

The invention relates generally to heat-exchange arrangements.

Heat-exchangers are known which include a housing and a nest or bundle of tubes arranged interiorly of the same. A cooling medium flows through the tubes whereas a fluid to be cooled flows through the housing and impinges the tubes exteriorly thereof. Baffles are arranged inside the housing for changing the direction of flow of the fluid to be cooled. By virtue of the impingement of the fluid to be cooled upon the outside surfaces of the conduits or tubes, the cooling medium flowing in the conduits may undergo vaporization.

Heat-exchangers of this type are utilized in cooling circuits which include a vaporizer, a compressor, a condenser and a pressure-reducing valve. Here, the cooling medium flows along a closed path. The cooling medium enters the heat-exchanger in liquid form and is vaporized therein by virtue of the heat-exchange which it undergoes with a fluid to be cooled, that is, the heat-exchanger serves as a vaporizer. After leaving the heat-exchanger, the cooling medium is compressed, condensed and subjected to a pressure reduction. In this manner, the cooling medium is returned to its original liquid state. The liquid cooling medium is then readmitted into the heat-exchanger.

The introduction of the cooling medium into a heat-exchanger of the type described above is generally controlled by means of a thermostatic expansion valve located upstream of the inlet for the liquid cooling medium and the opening and closing of which are effected by means of external pressure equalization. The open and closed phases of the expansion valve are regulated in dependence upon the output from a pressostat and a thermostat arranged downstream of the outlet opening for the vaporized cooling medium. This regulation resides in that liquid cooling medium is permitted to enter the heat-exchanger only when the pressostat and the thermostat register a completely gaseous condition for the cooling medium at the outlet of the heat-exchanger. This design serves not only as a means for controlling the operation of the heat-exchanger but serves also as a safety measure for the compressor arranged downstream of the outlet opening for the cooling medium. Thus, impingement of the compressor by drops of liquid cooling medium sucked in by the compressor may cause severe damage to the latter.

The efficiency of a heat-exchanger of the above type with respect to the cooling circuit has been found to be no better than that of the tube which exhibits the poorest heat transfer and which, concomitantly, provides for the poorest vaporization of cooling medium within the nest of tubes. The reason is that the cooling medium flowing in the tube having the poorest heat transfer characteristics passes through the tube in liquid form and causes the thermostat and pressostat to close the expansion valve located in the region of the inlet of the heat-exchanger. The result is that the remaining tubes of the nest, which provide for better vaporization, contain less cooling medium than they are capable of vaporizing on the basis of their design. In practice, the gaseous phase of the cooling medium is then disadvantageously shifted towards the inlet of the heat-exchanger, that is, complete vaporization of the cooling medium occurs closer to the inlet of the heat-exchanger than would be the case otherwise. As a consequence, the efficiency of the heat-exchanger and, concomitantly, the efficiency of the entire cooling circuit, is substantially decreased.

In order to alleviate these disadvantages to some extent, it has been necessary in the past to either construct larger heat-exchangers or to arrange a number of smaller heat-exchangers in series. However, this not only results in large space requirements and high costs but also requires the performance of more work at the suction side of the compressor.

A heat-exchanger of the type under consideration which has become known from the DT-AS 1,077,681 attempted to overcome the foregoing disadvantages by conveying the cooling medium through the nest of tubes progresively along a plurality of paths. Here, covers are provided at the opposite ends of the nest of conduits, the cover serving as baffles which cause the cooling medium exiting from one of the conduits to flow into another of the conduits. The covers are provided with separating webs and connecting members on their inner sides. On the one hand, the separating webs and connecting members are arranged so that the cooling medium is initially introduced into the conduits constituting the uppermost horizontal row of the nest and into the conduits constituting the lowermost horizontal row of the nest. On the other hand, the separating webs and connecting members are arranged so that the cooling medium is each time deflected only from one horizontal row of conduits to the immediately adjacent overlying or underlying row of conduits. The separating webs and connecting members are further arranged in such a manner that the cooling medium exits from the heat-exchanger via one of the covers and at a level of the latter corresponding approximately to the horizontal symmetry axis thereof. Moreover, provision is made for a progressive increase in the volume interiorly of the conduits so as to adjust for the increase in volume of the cooling medium as it vaporizes. The preceding measures are intended to achieve a better vaporizing effect and an accompanying improved efficiency. Nevertheless, even with this heat-exchanger it is not possible to avoid the passsage of cooling medium through the nest in liquid phase. One of the reasons for this resides in that the housing in which the nest of tubes is accommodated has an internal cross-section which is of circular configuration. Thus, on the one hand, despite the provision of baffles, the fluid to be cooled impinges the external surfaces of the tubes with varying flow velocities due to the circular configuration of the housing. On the other hand, so-called "dead edges" exist in the housing and the tubes arranged in these dead edges can be only partially impinged by the fluid to be cooled. Particularly dangerous conditions exist here in view of the danger that the cooling medium will pass through the nest of tubes in liquid phase.

It may be seen, therefore, that improvements in the state of the art are desirable.

SUMMARY OF THE INVENTION

A general object of the invention is to provide a novel heat-exchange arrangement.

Another object of the invention is to provide a heat-exchange arrangement which enables a more uniform heat transfer than was possible heretofore to be achieved.

A further object of the invention is to provide a heat-exchange arrangement which enables higher efficiencies than were obtainable heretofore to be realized.

An additional object of the invention is to provide a heat-exchange arrangement which is of a more compact construction than the heat-exchangers of the prior art.

A concomitant object of the invention is to provide a heat-exchanger of the type outlined above which enables the disadvantages described previously to be avoided and which, while having a compact construction, enables a completely uniform quantity of cooling medium to be vaporized in each conduit of the conduit nest and also enables the completely vaporized cooling medium to be superheated with respect to the vaporization temperature in the final portions of the flow paths defined by the conduits.

These objects, as well as others which will become apparent as the description proceeds, are achieved in acccordance with the invention. According to one aspect of the invention, there is provided a heat-exchange arrangement which comprises a housing having an inner surface defining a first flow path for a fluid to undergo heat-exchange. The inner surface of the housing includes a pair of substantially parallel surface portions which bound the first flow path along the flow direction so that the first flow path is of substantially constant width along the flow direction. A plurality of spaced conduits is arranged in the first flow path and defines a series of second flow paths for a medium to undergo heat-exchange with a fluid flowing in the first flow path. The conduits are arranged such that substantially the same predetermined minimum distance separates the most closely spaced ones of the conduits. A plurality of baffles is provided in the first flow path for regulating the flow pattern of a fluid flowing therein. The baffles are arranged in such a manner that, in the region between two adjacent ones of the baffles, the projected free flow cross-section of the first flow path as determined in a plane substantially paralleling the conduits is substantially equal to the projected free flow cross-section of the first flow path as determined in a plane substantially normal to the conduits.

Of particular interest to the invention is a heat-exchange arrangement or heat-exchanger of the type wherein a cooling medium is vaporized. The preferred form of heat-exchanger according to the invention has a nest of conduits, and a cooling medium flows through the interiors of the conduits whereas a fluid to be cooled impinges the external surfaces of the conduit nest interiorly of a housing. The preferred form of heat-exchanger in accordance with the invention also includes baffles arranged interiorly of the housing and which are provided for the fluid to be cooled. For the sake of simplification, the description herein will be primarily with reference to the preferred arrangement just outlined.

A particularly favorable embodiment of the invention contemplates for the housing, or at least the interior thereof, to have a substantially rectangular cross-sectional configuration. As indicated previously, the distance of separation of the conduits from one another, that is, the minimum distance separating the most closely spaced ones of the conduits, is advantageously constant. Moreover, it is preferred for the conduits to be spaced from the inner surface or wall of the housing and for the spacing between the inner wall of the housing and the conduits most closely adjacent thereto to substantially equal the minimum distance of separation of the conduits. Also, as pointed out earlier, the ratio of the projected free flow cross-section of the fluid to be cooled in directions parallel and perpendicular to the conduits is preferably approximately 1:1 in the region between two adjacent baffles.

It has been surprisingly determined that, by virtue of the combination of these characteristics, each conduit is, on the average, completely uniformly impinged by the fluid to be cooled while so-called "dead zones" are eliminated. Consequently, due to the resulting completely uniform heat transfer from the outer sides to the inner sides of the conduits, a completely uniform vaporization of the cooling medium in the interiors of the conduits is achieved. Noteworthy here is that, by virtue of the ratio of about 1:1, in the region intermediate two adjacent baffles, between the projected free flow cross-sections parallel and perpendicular to the conduits of the fluid to be cooled, the flow velocities perpendicular and parallel to the conduits may be maintained substantially the same. For water, the optimum value of the flow velocity lies between about 1 and 1.2 meters per second.

It has also been surprisingly found that the length of the conduit nest according to the invention need be only about one-half of the optimum length, as calculated from the appropriate literature sources, for conventional heat-exchangers having housings of circular configuration or cross-section. Moreover, it has been further found that, despite the relatively small dimensions of the conduit nest in accordance with the invention, the conduit nest is still capable of possessing a super-heating stretch, that is, a portion along which the cooling medium is heated above its vaporization temperature, which is of the order of 5 to 10% of the total length of the conduit nest. Here, the flow direction of the fluid to be cooled is advantageously transverse and countercurrent to the flow direction of the cooling medium, that is, the fluid to be cooled advantageously includes a flow component which is transverse to the direction of flow of the cooling medium as well as a flow component which is countercurrent to the direction of flow of the cooling medium.

By virtue of the above characteristics, it is possible, for example, to design a heat-exchanger having a heat transfer capacity per unit area of approximately 25,000 to 30,000 kilocalories per square meter per hour in the following manner: The conduits are arranged so as to define a grid pattern having a grid spacing of substantially 10 millimeters. The grid pattern has four-by-nine conduits, that is, a shorter side of the grid pattern is defined by a row of four conduits and a longer side of the grid pattern is defined by a row of nine conduits. The conduits have outer diameters of substantially 8 millimeters, wall thicknesses of substantially 0.5 millimeter and lengths of substantially 1250 millimeters.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
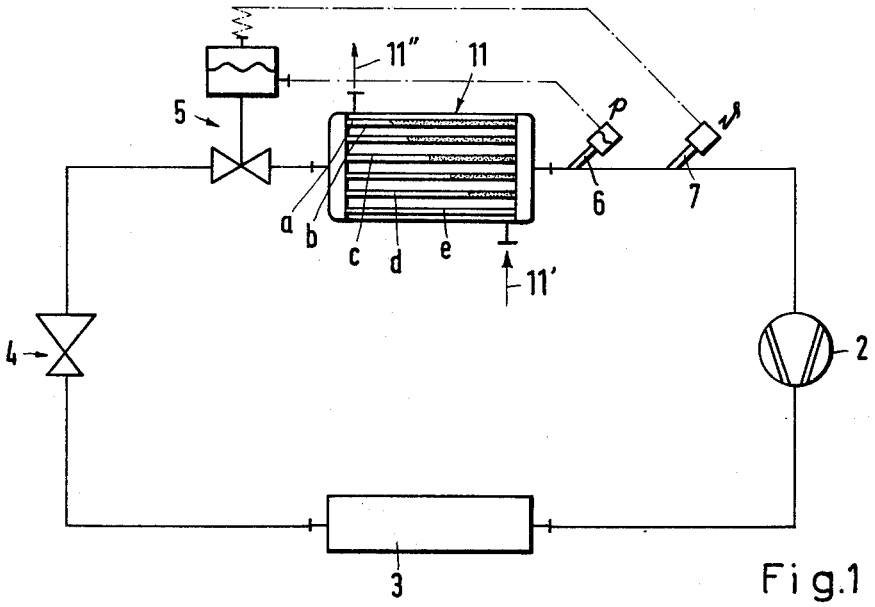
FIG. 1 schematically illustrates a cooling circuit having a heat-exchanger interposed therein.

Referring now to the drawing in detail, it is pointed out that FIG. 1 thereof is presented so as to provide a better understanding of the invention and so as to illustrate one application of a heat-exchanger in accordance with the invention. FIG. 1 illustrates a cooling circuit which is here assumed to be in communication with a heat pump circuit.

The cooling circuit of FIG. 1 includes a heat-exchanger or vaporizer 11, a compressor 2, a condenser 3 and a pressure-reducing valve 4. It may be seen that the heat-exchanger 11 is of the type having a nest of conduits arranged in a housing. The heat-exchanger 11 is provided with an inlet pipe connection or inlet 11' and an outlet pipe connection or outlet 11''. A fluid to be cooled such as, for instance, water, flows into the heat-exchanger 11 through the inlet 11'. In the heat-exchanger 11, the fluid to be cooled gives up a portion of its heat content (enthalpy) to the cooling medium present in the conduits. Thereafter, the fluid to be cooled leaves the heat-exchanger 11 via the outlet 11''.

The heat transfer between the fluid to be cooled and the cooling medium causes vaporization of the latter. The cooling medium vaporized in the heat-exchanger 11 is sucked in by the compressor 2, brought to a higher pressure and temperature level and then forced into the condenser 3. In the condenser 3, the cooling medium condenses and gives up a portion of its heat content during the condensation period. This heat may be given up to a suitable heat-removing arrangement such as, for example, an underfloor heating arrangement, a ventilating system or the like, which is arranged in heat-exchange relationship with the condenser 3. Subsequently, the cooling medium flows out of the condenser 3 and through the pressure-reducing valve 4. In the later, the cooling medium is subjected to a quasi-adiabatic expansion and is thereby further cooled. By virtue of the pressure-reducing valve 4, the cooling medium achieves approximately the same temperature and pressure values which it possessed when it originally entered the heat-exchanger 11.

The introduction of the cooling medium into the heat-exchanger 11 is regulated by means of a thermostatic expansion valve 5 the opening and closing of which are effected via external pressure equalization as schematically represented by the membrane shown in FIG. 1. It may be seen that the expansion valve 5 is arranged upstream of the inlet which is provided in the heat-exchanger 11 for the cooling medium. The open and closed phases of the expansion valve 5 are controlled in dependence upon a pressostat 6 and a thermostat 7 which are arranged downstream of the outlet provided for the cooling medium in the heat-exchanger 11. It may be seen that the pressostat 6 and the thermostat 7 are connected with the membrane which serves to provide external pressure equalization. The pressostat 6 and the thermostat 7 control the expansion valve 5 in that the latter is maintained in its closed position so long as the pressostat 6 and the thermostat 7 detect cooling medium in liquid phase leaving the heat-exchanger 11. It is only when the pressostat 6 and the thermostat 7 register a totally gaseous phase for the cooling medium in the region of the outlet end provided for the latter in the heat-exchanger 11 that the thermostatic expansion valve 5 is opened with external pressure equalization and liquid cooling medium is again permitted to enter the heat-exchanger 11 for vaporization.

Referring still to FIG. 1, it may be seen that the individual conduits of the heat-exchanger 11 have been identified with the reference characters *a*, *b*, *c*, *d* and *e*. For the prior art heat-exchangers of the type represented by the heat-exchanger 11, it has been found in the past that the efficiency of such a heat-exchanger with respect to the cooling circuit is only so good as that of the conduit which possesses the poorest heat transfer characteristics and which, concomitantly, provides the poorest vaporization of cooling medium interiorly of the conduit nest. In the present instance, let it be assumed that the conduit *a* provides the best heat transfer effect. This has the result that the cooling medium entering the conduit *a* is already completely vaporized after having passed through only a relatively short section of the conduit *a*. On the other hand, let it be assumed that the conduit e provides the poorest heat transfer effect so that the cooling medium leaves this conduit in liquid phase. The conduits *b*, *c* and *d* are assumed to provide vaporizing effects which lie between the extreme values represented by the conduits *a* and *e*.

Considering now the consequences of the foregoing, it may be seen that the cooling medium which passes through the conduit *e* in liquid phase causes the pressostat 6 and the thermostat 7 to maintain the thermostatic expansion valve 5 is a closed position. In fact, the expansion valve 5 will be maintained in a closed position until such time as, by virtue of corresponding pressure and temperature conditions, the presence of exclusively cooling medium vapor at the outlet end of the heat-exchanger 11 which is provided for the cooling medium is indicated to the pressostat 6 and the thermostat 7. This leads to the result that the conduit e providing the poorest heat transfer effect determines the quantity of cooling medium which is vaporized in the heat-exchanger 11 per unit of time and, thereby, determines the efficiency of the heat-exchanger 11 as well as of the overall cooling circuit.

Figure 2:
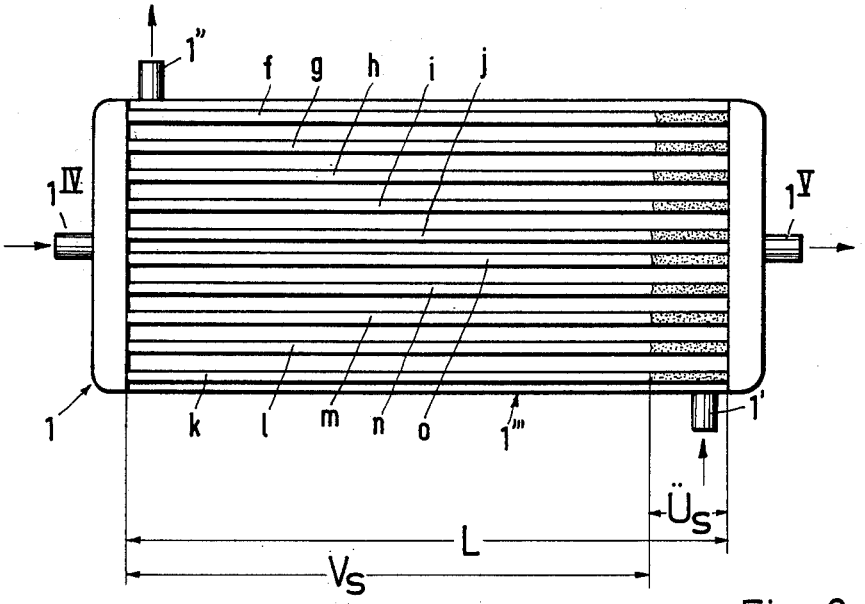
FIG. 2 schematically illustrates a heat-exchanger according to the invention and indicates a vaporizing portion and a super-heating portion of the heat-exchanger.

In contrast, the schematically illustrated heat-exchanger 1 according to the invention shown in FIG. 2 provides a completely uniform vaporizing effect in its conduits *f–o*. The heat-exchanger 1 is provided with an inlet conduit $1^{IV}$ for the introduction of a cooling medium into the conduits *f–o* and is also provided with an outlet conduit $1^{V}$ for the withdrawal of the cooling medium from the conduits *f–o*. The heat-exchanger 1 further includes a housing 1''' in which the conduits *f–o* are arranged. The housing 1''' is provided with an inlet pipe connection or inlet 1' for the introduction therein of a fluid to be cooled and is further provided with an outlet pipe connection or outlet 1'' for the withdrawal of the fluid.

The fluid to be cooled enters the housing 1''' via the inlet 1' and, through the conduits *f–o*, gives up a portion of its content to the cooling medium. Thereafter, the fluid leaves the housing 1''' via the outlet 1''. Meanwhile, the cooling medium enters the heat-exchanger 1 through the inlet $1^{IV}$ in predominantly liquid phase. The cooling medium is completely converted into the vapor phase along the stretch or section identified by $V_s$. In a subsequent super-heating stretch or section identified by $U_s$, the cooling medium is slightly super-heated with respect to its vaporization temperature. Thereafter, the cooling medium leaves the heat-exchanger 1 via the outlet $1^{V}$ and is sucked in by a compressor such as the compressor 2 of FIG. 1.

Due to the fact that, in accordance with the invention, the tendency of the cooling medium to pass through the conduits in liquid phase may be eliminated, it is possible to shorten the vaporizing conduits *f–o* according to the invention by about one-half as opposed to the vaporizing conduits of the prior-art constructions. Consequently, the pressure drop of the cooling fluid when it passes through the heat-exchanger 1 in accordance with the invention may also be decreased as opposed to the pressure drops observed in the prior-art constructions. As a result, for otherwise identical conditions, a higher pressure than in the prior art exists at the suction intake of the compressor in accordance with the invention. According to the laws governing gas compressors, this higher pressure has the effect of increasing the conveying capacity of the compressor. This, in turn, leads to an increase in cooling capacity. For a pressure increase of 0.1 atmospheres at the compressor inlet, an increase in cooling capacity of about 4 to 5% may be achieved.

Referring now to FIGS. 3–6, it is pointed out that these illustrate a practical embodiment of the invention. Where appropriate, the same reference characters as in FIG. 2 have been used in FIGS. 3–6.

Figure 5:
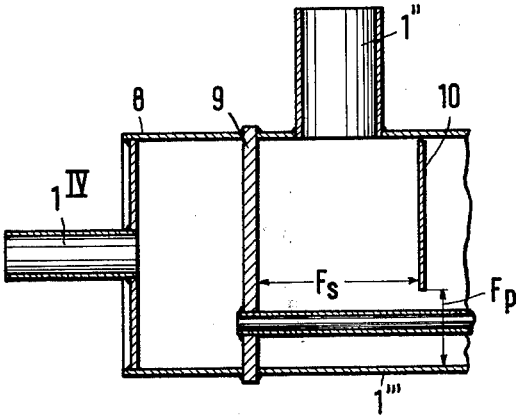
FIG. 5 is an enlarged vertical sectional view of the portion of the heat-exchanger indicated at V in FIG. 3.

The heat-exchanger 1 of FIGS. 3–6 is provided with tube plates or support member 9 for supporting the conduits (such as the conduits *f–o* of FIG. 2) of the conduit nest. As best illustrated in FIG. 5, the tube plates 9 are arranged in the regions of the respective longitudinal ends of the conduit nest. The conduits are connected with the tube plates 9 and this may be accomplished in known manner such as, for instance, by expanding the conduits into the tube plates 9 or by welding or soldering the conduits to the tube plates 9.

The heat-exchanger 1 is further provided with caps 8 and 8' one of which is arranged in the region of each of the longitudinal ends of the conduit nest. The caps 8 and 8' are welded to the respective tube plates 9. In the interior of the housing 1''' of the heat-exchanger 1, there are provided baffles 10 and 10' for regulating the flow pattern of a fluid to be cooled. The arrangement of the baffles 10 and 10' is particularly evident from FIGS. 5 and 6.

Figure 6:
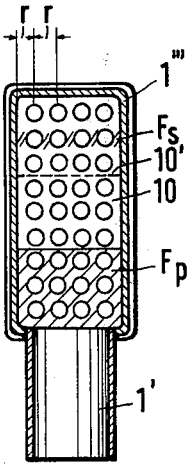
FIG. 6 is a sectional view in the direction of the arrows VI—VI of FIG. 3.

As is most readily apparent from FIG. 6, the housing 1''' has a rectangular cross-sectional configuration. It may also be seen that the minimum distance of separation of the conduits from one another, as well as the distance between the inner wall of the housing 1''' and the conduits adjacent thereto, is constant. In other words, the distance of separation between conduits is the same for all most closely adjacent pairs of conduits whereas the distance between the inner wall of the housing 1''' and the conduits most closely adjacent thereto equals the minimum distance of separation of the conduits from one another. The minimum distance of separation of the conduits from one another and, concomitantly, the distance between the inner wall of the housing 1''' and the conduits most closely adjacent thereto, is also referred to here as the grid spacing *r* which is indicated in FIG. 6.

According to an advantageous embodiment of the invention, the grid spacing *r* is 10 millimeters. Here, the conduits, which are favorably composed of corrosion-resistant or stainless steel, have outer diameters of 8 millimeters, wall thicknesses of 0.5 millimeter and lengths of 1250 millimeters. Although a heat-exchanger designed in this manner is of compact construction, it is nevertheless surprisingly possible to achieve a heat transfer capacity per unit area of 25,000 to 30,000 kilocalories per square meter per hour.

Although certain principles of the invention have been detailed to this point, there is, however, another important factor in the solution of the prior-art problems in accordance with the invention. This resides in the arrangement of the baffles 10 and 10'. The baffles 10 and 10' are arranged in such a manner that, intermediate two adjacent baffles, e.g. intermediate the baffle 10' shown in FIGS. 3 and 6 and the baffle 10 immediately to the right or the left thereof shown in FIG. 3, as well as intermediate the terminal baffles 10 and the respective tube plates 9, the ratio of the projected free flow cross-sectional areas $F_p$ and $F_s$ of the fluid to be cooled parallel and perpendicular to the conduits, respectively, is approximately 1:1. The shading in FIG. 6 indicates what is to be understood here by the projected free flow cross-sectional areas $F_s$ and $F_p$.

Figure 3:
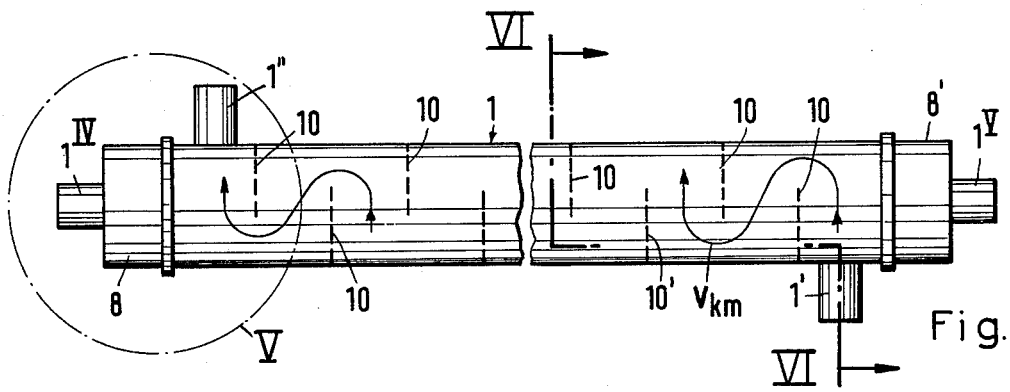
FIG. 3 is a side view of a practical embodiment of a heat-exchanger in accordance with the invention.
Figure 4:
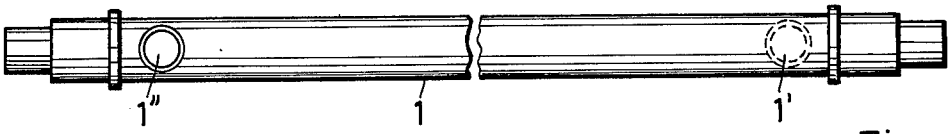
FIG. 4 is a plan view of the embodiment of FIG. 3.

The ratio of approximately 1:1 between the areas $F_s$ and $F_p$ has the result that the flow velocity $V_{km}$ of the fluid to be cooled is completely constant from the inlet 1' to the outlet 1'' of the heat-exchanger 1 as is indicated by appropriate curved arrows in FIG. 3. The rectangular cross-sectional configuration of the housing 1''', as well as the constant grid spacing *r* of the conduits from one another and from the inner wall of the housing 1''', have the additional effect of providing for a completely uniform impingement of the conduits by the fluid to be cooled. Consequently, a completely uniform heat transfer from the fluid to be cooled to the cooling medium to be vaporized occurs, and as a result, a highly effective and uniform vaporizing effect is achieved. When the fluid to be cooled was water, the flow velocity was of the order of 1–1.2 meters per second and a super-heating stretch $U_s$ (see FIG. 2) of 5 to 10% of the total length L of the conduit nest resulted (see FIG. 2).

It may be pointed out here that, in accordance with the invention, the conduits and the housing 1''' are advantageously composed of copper or corrosion-resistant steel.

It will be self-understood that the principles of the invention may also be extended to other conduit dimensions when the rectangular cross-sectional configuration of the housing 1''' and a constant grid spacing *r* for the conduits are maintained, and when, in dependence upon the aforementioned dimensions, the baffles 10 and 10' are so arranged interiorly of the housing 1''' that, in the region between two adjacent baffles 10 and 10', as well as in the region between a terminal baffle 10 and 10' and the respective tube plate 9, the ratio of the projected free flow cross-sectional areas $F_p$ and $F_s$ of the fluid to be cooled parallel and perpendicular to the conduits is approximately 1:1. It is further pointed out that, in view of the increase in volume of the cooling medium during vaporization of the same, it is possible to connect the conduits in a progressive and uniform manner instead of providing an arrangement such as illustrated for the embodiment of FIGS. 3–6. In other words, it is possible to connect the conduits so that the cooling medium flows progressively and uniformly from one conduit to another. This may be accomplished in known manner by providing suitable baffle members at the longitudinal ends of the conduit nest.

It will be understood that each of the elements described above, or two or more together, may also find a useful application in other types of constructions differing from the types described above.

While the invention has been illustrated and described as embodied in a heat-exchanger for cooling circuits, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A heat-exchange arrangement, comprising a housing of substantially rectangular cross-sectional configuration having an inner surface which defines a first flow path for a fluid to undergo heat-exchange; a plurality of spaced, substantially parallel conduits in said first flow path defining a series of second flow paths for a medium to undergo heat-exchange with a fluid flowing in said first flow path, said conduits being arranged such that the most closely adjacent ones thereof are spaced from one another by substantially the same predetermined distance and such that the spacing between said inner surface and the conduits most closely adjacent thereto substantially equals said predetermined distance; at least one wall in said housing, said one wall bounding said first flow path at a longitudinal end thereof; and a plurality of axially spaced baffles in said first flow path for regulating the flow pattern of a fluid flowing in said first flow path, adjacent ones of said baffles, as well as said wall and the baffle adjacent thereto, defining with one another flow regions for a fluid flowing in said first flow path, and each of said baffles having an edge which is spaced from said inner surface and together with the latter defines a space connstituting a boundary area between the respective neighboring regions, said baffles being arranged in such a manner that a first projected free flow cross-section of said first flow path as determined in any one of said regions approximately equals a second projected free flow cross-section of said first flow path as determined at a boundary area for said one region, and said first projected free flow cross-section being determined in a plane substantially parallel to said conduits whereas said second projected free flow cross-section is determined in a plane substantially normal to said conduits.

2. An arrangement as defined in claim 1, said housing having a first inlet and a first outlet for a fluid to be conveyed along said first flow path, and said housing having a second inlet and a second outlet for a medium to be conveyed along said second flow paths; and wherein said inlets, said outlets and said baffles are arranged in such a manner that a fluid conveyed along said first flow path has a first flow component which is substantially countercurrent to the flow of a medium conveyed along said second flow paths, and a second flow component which is transverse to the flow of the medium.

3. An arrangement as defined in claim 1, wherein said conduits are distributed over substantially the entire interior cross-section of said housing.

4. An arrangement as defined in claim 1, said first flow path being of predetermined length, and each of said conduits including a portion having said predetermined length; and wherein said conduits are constructed and arranged such that a vaporizable medium conveyed therethrough becomes substantially completely vaporized prior to leaving said portions and is heated above the vaporization temperature of the medium along stretches of said portions which have lengths between substantially 5 and 10 percent of said predetermined length.

5. An arrangement as defined in claim 1, said conduits having outer diameters of substantially 8 millimeters, wall thicknesses of substantially 0.5 millimeter and lengths of substantially 1250 millimeters; and wherein said conduits are arranged in the form of a substantially rectangular grid having a grid spacing of substantially 10 millimeters, said and including a longer side defined by a row of nine of said conduits and a shorter side defined by a row of four of said conduits, and said conduits having a heat transfer capacity between about 25,000 and 30,000 kilocalories per square meter per hour.

6. An arrangement as defined in claim 1, wherein said conduits and said housing are each composed of a substance selected from the group consisting of copper and corrosion-resistant steel.

7. An arrangement as defined in claim 1, wherein said conduits and said baffles are so arranged in said first path as to permit a flow velocity of about 1 to 1.2 meters per second to be achieved when the fluid flowing in said first flow path is water.

8. An arrangement as defined in claim 1, said conduits having spaced opposite ends; and wherein baffle members are provided in the regions of said opposite ends for changing the direction of flow of a medium conveyed through said conduits, said baffle members and said conduits being arranged so as to take into account the increase in volume of the medium as the latter undergoes vaporization and such that the medium flows progressively from one conduit to an adjacent conduit upon being diverted by said baffle members.

9. An arrangement as defined in claim 1, wherein supporting members are provided for supporting said conduits, and said supporting members and said conduits are connected with one another.

10. An arrangement as defined in claim 9, wherein said supporting members and said conduits are connected by an expansion fit.

11. An arrangement as defined in claim 9, wherein said supporting members and said conduits are welded to one another.

12. An arrangement as defined in claim 9, wherein said supporting members and said conduits are soldered to one another.

* * * * *